US005814940A

United States Patent [19]

Fujisawa

[11] Patent Number: 5,814,940

[45] Date of Patent: Sep. 29, 1998

[54] RADIO FREQUENCY PARTICLE ACCELERATOR HAVING MEANS FOR SYNCHRONIZING THE PARTICLE BEAM

[75] Inventor: Takashi Fujisawa, Saitama-ken, Japan

[73] Assignee: Denki Kogyo Co., Ltd., Tokyo, Japan

[21] Appl. No.: 631,452

[22] Filed: Apr. 12, 1996

[30] Foreign Application Priority Data

Apr. 12, 1995 [JP] Japan ..... 7-085825

[51] Int. Cl.[6] ..... H05H 7/22

[52] U.S. Cl. ..... 315/5.41; 315/5.51; 315/500; 315/505

[58] Field of Search ..... 315/5.41, 5.42, 315/5.51, 500, 505

[56] References Cited

U.S. PATENT DOCUMENTS

| | | | |
|---|---|---|---|
| 4,140,942 | 2/1979 | Auslender et al. | 315/5.41 |
| 5,038,077 | 8/1991 | Gold et al. | 315/5.51 |
| 5,144,193 | 9/1992 | Warren | 315/4 |

FOREIGN PATENT DOCUMENTS

| | | | |
|---|---|---|---|
| A0094889 | 11/1983 | European Pat. Off. | H05H 9/04 |
| 40195499 | 4/1989 | Japan | 315/500 |
| 401186800 | 7/1989 | Japan | 315/500 |
| 6-298799A | 10/1994 | Japan | H05H 7/02 |

OTHER PUBLICATIONS

Low Energy RF Electron Accelerator for Electron Beam Irradiation, by Takashi Fujisawa, et al., presented at the 9th Symposium on Accelerator Science and Technology, Tsukuba, Japan, 1993, pp. 178–180.

Development of an RF Electron Beam Irradiation System, by T. Fujisawa, et al., 10th Symposium on Accelerator Science and Technology, Hitachinaka, Japan, Oct. 25–27, 1995, pp. 64–66.

*Primary Examiner*—Benny T. Lee

*Attorney, Agent, or Firm*—Trop, Pruner, Hu & Miles, P.C.

[57] ABSTRACT

The invention relates to a radio-frequency particle accelerator. First and second cylindrical inner conductors 4 and 5 are disposed on the axis of the particle beams from the particle beam entrance with an accelerating gap interposed between the inner conductors in a TM or TEM mode particle accelerating cavity. An end of the first inner conductor 4 and an end of the second inner conductor 5 are joined to base plates of an outer conductor 3 of the accelerating cavity to form an inductance and together with the capacitance across the gap to form a resonant cavity. In order to synchronize particle beams with the radio-frequency accelerating phases, a bunching gap 11 with an inductance is formed by forming slots 11*a* on the first inner conductor 4. Thus, a radio-frequency electric power for exciting the accelerating cavity 2 is automatically supplied to the bunching gap 11 through the inductive coupling.

7 Claims, 11 Drawing Sheets

RADIO FREQUENCY PARTICLE ACCELERATOR HAVING MEANS FOR SYNCHRONIZING THE PARTICLE BEAM

FIELD OF THE INVENTION AND RELATED ART STATEMENT

The present invention relates to radio-frequency particle accelerators operating in frequency bands of VHF, UHF, etc.

All of low or middle energy (5 MeV or less) electron accelerators which have been conventionally used for industrial radiation processing are DC accelerators. Though radio-frequency particle (RF) accelerators of less than 2 MeV are used for processing in Russia, there is a problem that the energy spread of the particles is wide because they lack a buncher.

A conventional RF linear particle (e.g. electron or ion) accelerator which has been used for research purposes is normally provided with a buncher between the injector and the RF accelerator, in order to bunch and center the particles generated by a DC voltage injector in an optimum RF accelerating phase of the particle accelerating cavity. A buncher is a device for bunching particles to center the particles into a narrow phase range of a highfrequency electromagnetic wave.

Such a conventional RF particle accelerator is so arranged, as shown in FIG. 13, that acceleration is achieved by letting the electrons or ions from the injector 101 pass sequentially through the buncher cavity section 102 and the RF accelerating cavity 103. In this case, radio-frequency electric power is supplied to the buncher 102 and the accelerator 103 in such a way that two outputs of a radio-frequency (RF) signal generator 104 have their phase adjusted by respective RF phase adjusters 105*a* and 105*b*, and are power-amplified by the respective RF power amplifiers (RF amplitude adjuster) 106*a* and 106*b*. The amplified RF power outputs are supplied to the buncher 102 and the RF accelerator 103, respectively. Alternatively, an RF signal picked up from the RF accelerating cavity 103 may be supplied to the buncher 102 through 105*a* and 106*a*.

FIG. 14 shows the movement of particles getting bunched and accelerated through an RF particle accelerator arranged as described above. In FIG. 14, the abscissa is time (the phase angle of the RF voltage) and the ordinate indicates the position of the particle. In FIG. 14, labelled "Applegate Diagram of Bunched Beam", the "position of particles" is indicated by the ordinate on which is labelled "Acceleration Gap", "Buncher" and "Electron Gun", while the abscissa is labelled "Phase Angle of RF Voltage". The points where electrons are bunched, the RF voltage at the acceleration gap and the RF voltage of the buncher are labelled.

While the particles (electrons or ions) are passing through the buncher 102, each particle has its speed changed by the RF electric field in the buncher 102, and thereafter moves at a constant speed. That is, the particles move with the passage of time as represented by angled lines in FIG. 14. At the entrance of the buncher 102, for example, electrons are uniformly distributed, and their speeds change in response to the electric field applied in the buncher 102, thereby electrons are focused or defocused in phase of RF electric field as shown in FIG. 14, while the electrons are traveling towards the entrance of the RF accelerating cavity. Thus, the buncher voltage and the RF accelerating phases are so adjusted that the bunches gather a large portion of injected electrons and are synchronized with the RF accelerating phases at the position of the accelerating gap in the RF accelerator 103.

There are several problems associated with the conventional scheme of RF particle accelerators such as described above. Though they are very convenient and useful to those who have enough knowledge about this kind of accelerators, they are too complicated and are difficult for those with poor knowledge of RF technology to properly use them, e.g., industrial accelerators.

Further, conventional RF particle accelerators need RF phase adjusters 105*a* and 105*b* and RF amplifiers 106*a* and 106*b*, which control RF amplitude. Therefore, accelerator systems are rather complicated.

Furthermore, if the buncher 102 has an RF cavity of a high Q value, the resonance frequency, the RF phase and the RF voltage of the buncher 102 have to be finely adjusted automatically to keep the buncher function properly.

For these reasons, the inventors previously proposed an RF particle accelerator equipped with a buncher which obtains bunching voltage automatically by means of capacitance division, in order to solve the above problems.

That is, the RF particle accelerator is so arranged that within a first inner conductor of a TM or TEM mode accelerating cavity, a buncher gap is provided with an insulator being used to set up the buncher gap. Bunching voltage is obtained by the capacitance division between the capacitance of the main acceleration gap between the first and second inner conductors and that of the buncher gap. (Japanese Patent Provisional Publication No. 6-295799 or No. 295799/1994.)

However, the above cited RF particle accelerator equipped with a buncher based on capacitance division has a problem of dielectric breakdown of the buncher gap insulator if the bunching voltage has to be high, e.g., higher than 5 kv.

OBJECT AND SUMMARY OF THE INVENTION

The present invention has been made from the above points of view. It is therefore an objective of the invention to solve the problem of capacity division and provide an RF particle accelerator which has improved reliability and durability with a simple structure without use of any insulator material.

It is another objective of the invention to provide an RF particle accelerator easy to operate in which RF voltage whose phase is always opposite to that of the accelerating cavity voltage is automatically applied in a very simple manner to the buncher gap as the RF power is supplied to the accelerating cavity.

The above described objectives are achieved by design based on this invention. In FIG. 1, first and second cylindrical inner conductors separated by a gap are disposed around the central axis of the particle beams. Inner conductors are designated as being first and second from the particle beam entrance. The entrance end of the first inner conductor and the exit end of the second inner conductor are joined to the base plates of outer cylindrical conductor of the accelerating cavity so as to form a main inductance and, together with the capacitance at the gap, form a resonant cavity. The present invention is characterized by the following features.

According to a first aspect of the invention, a bunching gap having an inductance is provided by forming circumferential partial slots around the first inner conductor so as to supply an RF electric power to the bunching gap by way of inductive coupling with the above-mentioned main inductance.

According to a second aspect of the invention, plural slots on the first inner conductor mentioned in the first aspect are formed at symmetrical locations on the periphery of the inner conductor.

According to a third aspect of the invention, the slots on the first inner conductor in accordance with the first aspect are formed at a plurality of symmetrical locations along a circumference of the first cylindrical conductor which is joined between the entrance end of the first inner conductor and the base plate of the outer conductor of the accelerating cavity and which is different in shape and size from the main part of the first inner conductor.

According to a fourth aspect of the invention, a slot is formed at a part of the first inner conductor, a third inner conductor is disposed around the central axis inside the first inner conductor, a bunching gap is formed between the center aperture in the base plate of the outer conductor of the accelerating cavity and the particle beam entrance end of the third inner conductor, and an RF electric power is supplied to the bunching gap through inductive coupling by means of the slotted part of the first inner conductor.

According to a fifth aspect of the invention, in any of the above first to fourth aspects, the second inner conductor may be removed from the exit side of the accelerating cavity, as acceleration gap is formed directly between the first inner conductor and central part of the exit-side base plate of the cavity.

By the above-described arrangements designed according to the present invention, the phase of the RF voltage applied to the buncher gap is always opposite to that of the accelerating cavity voltage, because RF electric power is automatically supplied from the particle accelerating cavity to the buncher through the inductive coupling, and there is no need of using any insulator.

As is apparent from the above, the RF particle accelerator according to the invention has a very simple structure without the need of using any insulator for the buncher, because the buncher and the accelerating cavity are formed into one body, and an RF electric power for exciting the buncher is supplied from the accelerating cavity through inductive coupling. This permits an improvement in the reliability and the durability of the accelerator.

Also, the invention has another effect that the supply of RF electric power to the accelerating cavity enables the RF electric power to be automatically supplied to the buncher with correct phase, and it makes the operation of the accelerator very simple and easy.

DETAILED DESCRIPTION OF THE PREFERRED EMBODIMENTS

Figure 1:
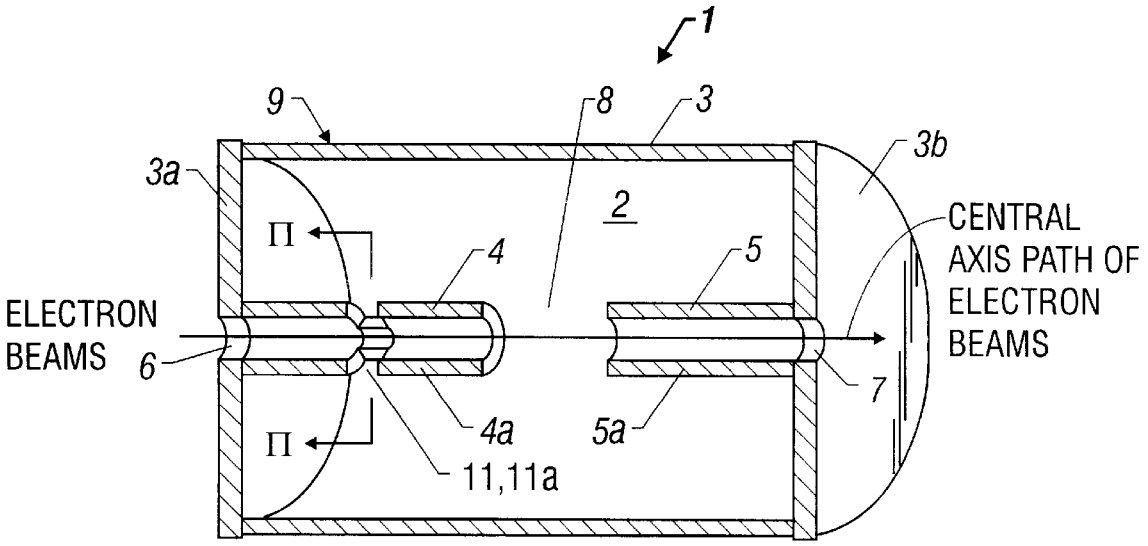
FIG. 1 is a cross-sectional perspective diagram showing an arrangement of an RF particle accelerator with an inductively-coupled buncher according to a first illustrative embodiment of the invention.

Referring to the drawings, preferred embodiments will be described in the followings.

[Embodiment I]

Figure 2:
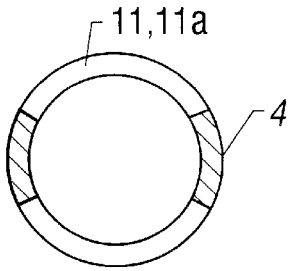
FIG. 2 is a cross-sectional diagram taken along the line II—II of FIG. 1.
Figure 3:
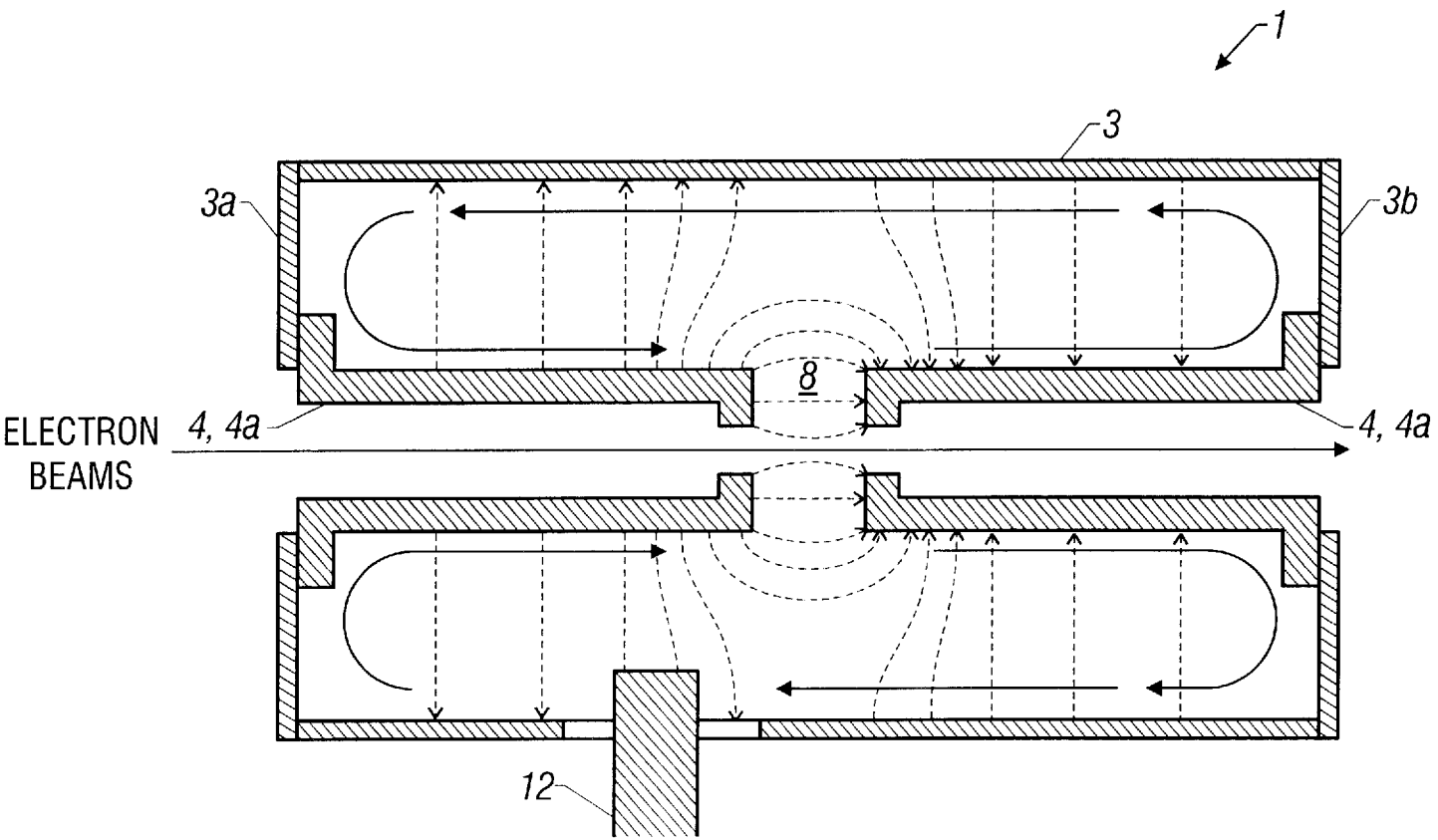
FIGURE 3 (PRIOR ART)
FIG. 3 shows exemplary prior art electric fields (broken lines) and electric currents (solid lines) in an illustrative prior art TEM mode RF particle accelerator.
Figure 4:
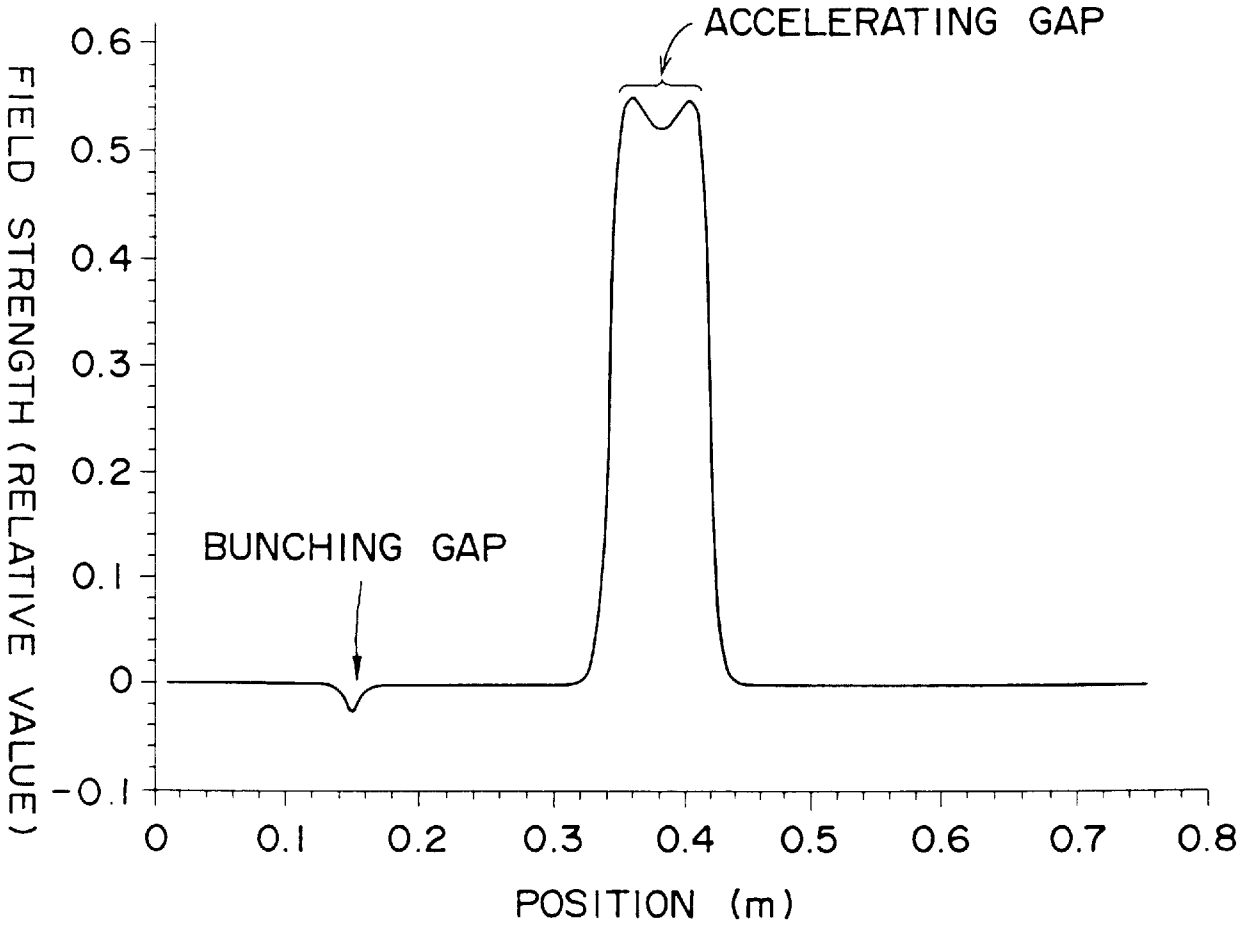
FIG. 4 is a graph showing an example of electric field distribution along acceleration axis of the accelerator of the present invention computed by a three dimensional code. Note the small field dip at the bunching gap which is not generated in the prior art accelerator.
Figure 5:
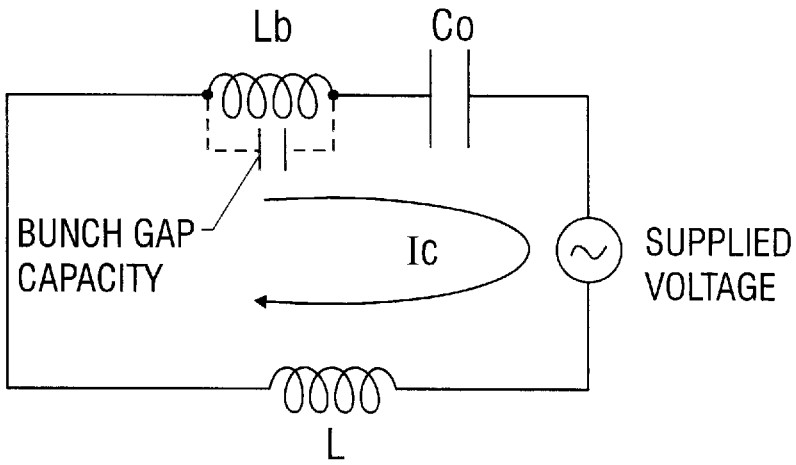
FIG. 5 is a lumped-constant equivalent circuit of the RF particle accelerator of FIG. 1.

FIGS. 1, 2, 4 and 5 are figures showing a first illustrative embodiment of an RF particle accelerator of the invention. Specifically, FIG. 1 is a cross-sectional perspective diagram showing an arrangement of an RF particle accelerator with inductively coupled buncher; FIG. 2 is a cross-sectional diagram taken along the line II—II of FIG. 1; FIG. 3 shows exemplary electric fields (broken lines) and electric currents (solid lines) in an illustrative prior art TEM mode RF particle accelerator; FIG. 4 is a graph showing an illustrative computed electric field distribution; and FIG. 5 is a lumped-constant equivalent circuit of the RF particle accelerator of FIG. 1.

In FIG. 1, the RF particle accelerator 1 comprises a cylindrical outer conductor 3 forming an outer shell of an accelerating cavity 2, and first and second cylindrical inner conductors 4 and 5 disposed on the central axis of the outer conductor 3, so that particle beams, e.g., electron beams, travel along the central axis via an entrance hole 6 and an exit hole 7 provided at the centers of respective end plates 3*a* and 3*b* of the outer conductor 3, thereby penetrating the outer conductor 3 through its central axis path.

The first and second cylindrical inner conductors 4 and 5 are disposed sequentially (in series) from the entrance side for the electron beams with an accelerating gap 8 positioned between them. The first inner conductor 4 has its entrance end joined to the entrance hole 6 of one end plate 3*a* of the outer conductor 3. The second inner conductor 5 has its exit end joined to the exit hole 7 of the other end plate 3*b* of the outer conductor 3. Also, the first and second inner conductors 4 and 5 form respectively a first and second cylindrical stems 4*a* and 5*a* each having a hole through which the electron beams pass.

In this way, a resonator 9 is composed of the outer conductor 3 and the first and the second inner conductors 4 and 5. Further, a bunching gap 11 is formed by providing plural slots (two slots in this embodiment) 11*a* at symmetrical positions along a circumference of the first inner conductor as shown in the cross section indicated in FIG. 2, taken along a plane perpendicular to the central axis.

It should be noted that while the accelerating cavity 2 may have any shape in this embodiment, the RF excitation mode is either TM or TEM mode.

On the other hand, the ordinary RF particle accelerator 1 shown in FIG. 3 has no slot 11*a* at any part of the first inner conductor, that is, has no bunching gap 11 in the first stem 4*a*. When an RF electric power is supplied through a power feeder 12 to excite a TEM RF electric field in the accelerator, the electric field and the electric current have such configurations shown in FIG. 3. Lines of electric force are indicated by broken lines, and the RF current flows by solid lines on the inner wall surface of the accelerating cavity 2. In this case, since no electric field occurs within the first stem 4*a* and the second stem 5*a*, the electron beams are affected by the RF electromagnetic field only in the accelerating gap 8 when the electron beams pass through the accelerator.

If a bunching gap 11 is provided by forming slots 11*a* at a certain part of the first stem 4*a*, the RF electromagnetic field leaks into the path of the electrons or charged particles. The results obtained from calculation of the electric field distribution by means of the three-dimensional finite element method are studied. FIG. 4 shows an example of a distribution of field strength on the acceleration axis. The abscissa indicates the position (m) measured from the left end of the outer conductor 3, and the ordinate indicates the field strength (relative value). The arrangement of FIG. 1 can be expressed by means of a lumped constant circuit (an equivalent circuit comprising elements having lumped constants) as shown in FIG. 5. The RF voltage (bunching voltage) $V_b$ is given from the RF current $I_c$ and an equivalent inductance $L_b$ by the expression:

$$V_b = j\omega L_b \times I_c,$$

where j is an imaginary number, and ω is the angular frequency of the RF current.

The lumped constant circuit shown in FIG. 5 is a series circuit comprising the inductance $L_b$ of the bunching gap 11, the capacitance $C_o$ of the accelerating gap 8 in the accelerating cavity 2 and the inductance L of the outer conductor 3 and of the inner conductors 4, 5. Specifically, the inductance $L_b$ of the bunching gap 11 is connected in series with the capacitance $C_o$ of the accelerating gap 8 in the accelerating cavity 2, which enables the supply of an RF electric power for exciting the buncher 11 by means of inductive coupling to the cavity. It is also apparent from the circuit of FIG. 5 that in the RF particle accelerator 1 of the illustrative embodiment shown in FIG. 1, the bunching voltage $V_b$ can be changed by changing the inductance $L_b$ of the bunching gap 11, while the phase of the bunching voltage $V_b$ is always opposite to that of the voltage of the accelerating gap 8. It is noted that the capacitance of the bunching gap ("bunch gap capacity")11 has been neglected in the above expression because the effect of the capacitance is very small.

In this case, the space 11 and conductors 4 in FIG. 2 constitute parts of a resonant circuit of the accelerating cavity 2 so that the space 11 itself does not resonate.

Thus, the electron beams are bunched by the bunching voltage $V_b$ across the bunching gap 11, and then accelerated in the accelerating gap 8. In FIG. 3, elements identical to those shown in FIG. 1 are labeled with identical numerals, and their explanations are omitted.

Figure 6:
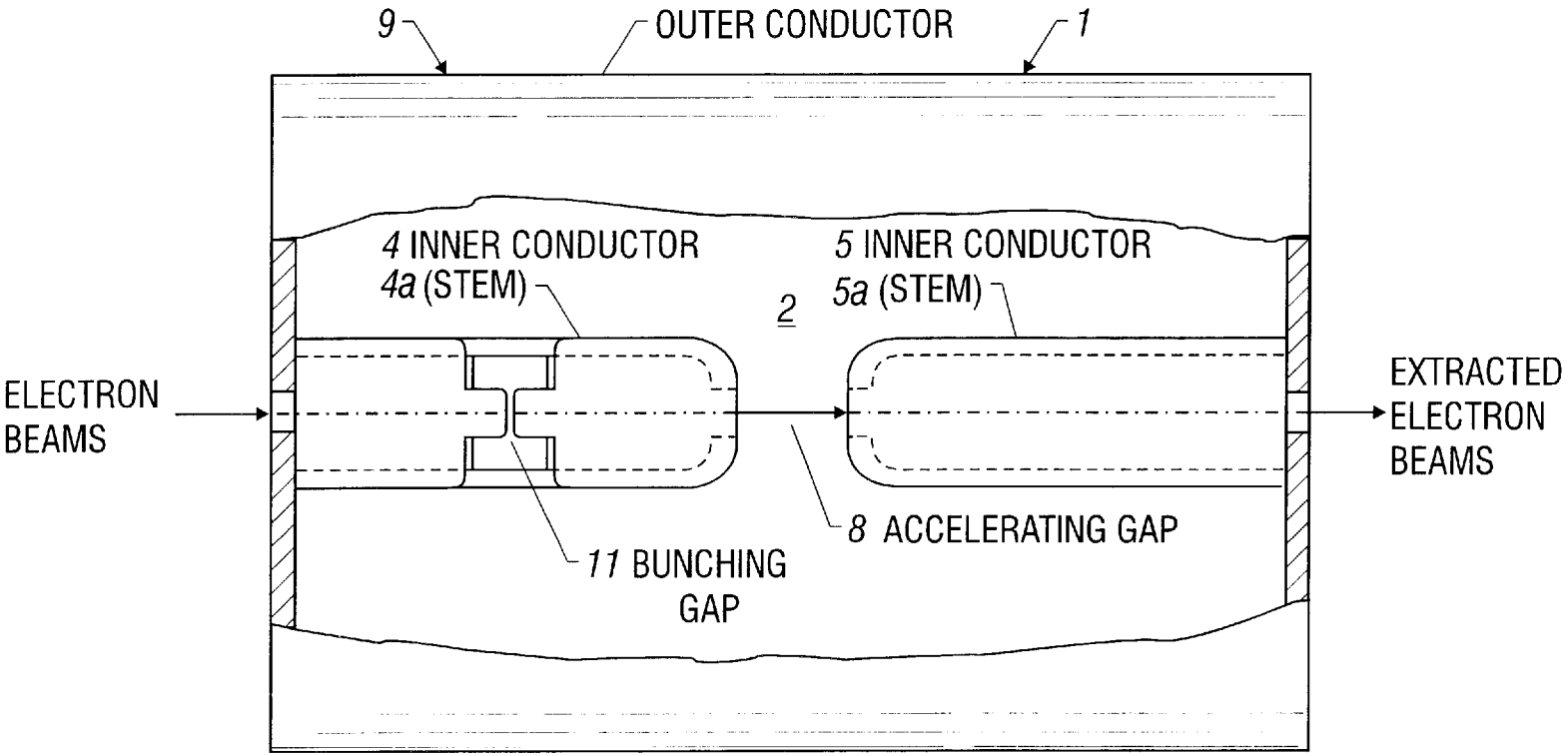
FIG. 6 is a side elevation showing a partial cross section of an illustrative example of the RF particle accelerator 1 according to the first embodiment.

FIG. 6 is a side elevation partially showing cross section of a specific example of the RF particle accelerator 1 according to the first embodiment. In FIG. 6, elements identical to those shown in FIG. 1 are labeled with identical numerals, and their explanations are omitted. The accelerating cavity 2 is of a single gap type with two ¼ -wavelength coaxial resonators facing each other. The RF mode is a TEM push-pull mode. The electrons are accelerated in the accelerating gap 8 formed between the first and second inner conductors 4 and 5 (the first stem 4*a* and the second stem 5*a*). In the accelerator 9, in order to let the generated RF electric field act effectively on the electrons, the bunching gap 11 is formed of conductors 20 mm in diameter which are facing each other at an interval of 5 mm and which constitute a part of the first inner conductor 4.

The distance between the bunching gap 11 and the accelerating gap 8 is determined by the incident energy (speed) of an electron and the accelerating RF frequency. In the embodiment, the length was 150 mm under the frequency of 182 MHz and the incident voltage of 5 kV. In this case, the bunching voltage was 3 kV.

In the above embodiment, from the calculation in which the space-charge effect of the electron beam was ignored, it was found that the electrons which have passed through the bunching gap 11 during a period of −100 to 20 degrees of the phase of the RF voltage of the buncher 11 reach the accelerating gap 8 in an interval of 70 to 100 degrees in the phase of the accelerating voltage. These electrons correspond in number to about one third of all the electrons which have passed the buncher 11.

When electrons were accelerated in the accelerator according to the invention, about 60% of the incident DC current was accelerated. This percentage is twice that (30%) of the case without the bunching gap. The energy resolution was measured by deflecting accelerated electrons with a deflecting magnet. The resultant resolution was about 4% taken at half maximum as shown in an energy spectrum diagram in FIG. 7. since the full width half maximum equals the change of energy over the energy of the accelerated electrons or 10 over 250.

Figure 7:
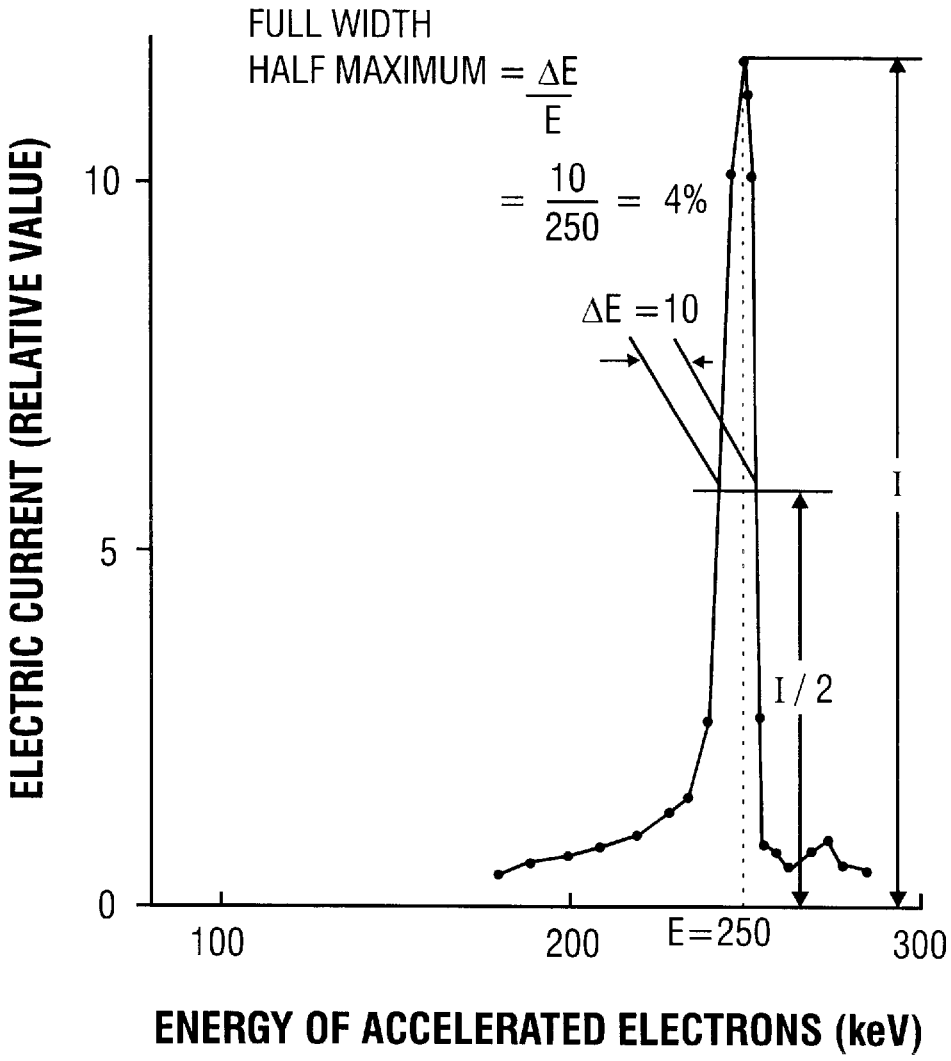
FIG. 7 shows a typical electron energy spectrum of accelerated electrons in the illustrative example of the RF accelerator 1 denoted in FIG. 6.

Namely, according to the curve shown in FIG. 7, a ratio (full width half maximum) of the energy width ΔE (10 keV) of accelerated electrons at the half maximum electric current I/2 to the energy value E(250 kev) at maximum current I was about 4%(ΔE/E=10/250).

[Embodiment II]

Figure 8:
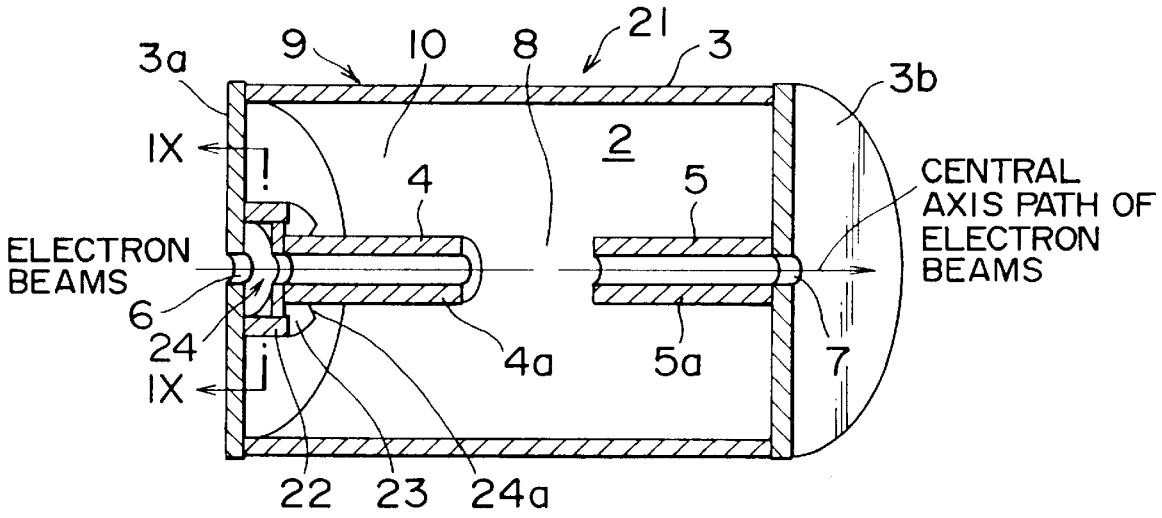
FIG. 8 is a cross-sectional perspective diagram showing an arrangement of an RF particle accelerator with an inductively-coupled buncher according to a second illustrative embodiment of the invention.
Figure 9:
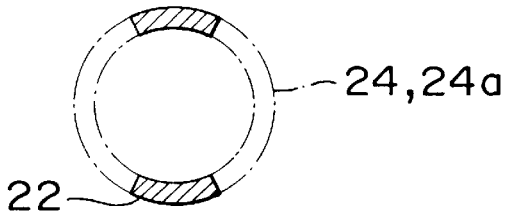
FIG. 9 is a cross-sectional diagram taken along the line IX—IX of FIG. 8.
Figure 10:
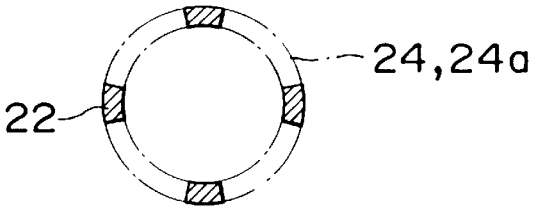
FIG. 10 is a cross-sectional diagram showing a modification of FIG. 9 by increasing the number of slots.

FIGS. 8 through 10 show a second illustrative embodiment of an RF particle accelerator of the invention. FIG. 8 is a cross-sectional perspective drawing showing an arrangement of another built-in buncher type RF accelerator for incoming electron beams, labelled "Electron Beams" which have a central axis labelled "Central Axis Path of Electron Beams"; FIG. 9 is a cross-sectional diagram taken along the line IX—IX of FIG. 8; FIG. 10 is a cross-sectional diagram showing a modification of FIG. 9 with the number of slots increased. In these figures, elements identical to those shown in FIG. 1 are labeled with identical numerals, and their explanations are omitted.

In FIG. 8, elements identical to those shown in FIG. 1 are labeled with identical numerals, and their explanations are omitted.

The RF particle accelerator 21 shown in FIG. 8 is an illustrative embodiment having a bunching voltage generating section comprising stem part different in diameter with other parts. A cylindrical conductor 22 is disposed and joined between the electron beam entrance end of the first inner conductor 4 and the center of an end plate 3*a* of the accelerating cavity outer conductor 3. The conductor 22 has an inner diameter larger than that of the outer diameter of the first inner conductor 4, has its one end joined to the end plate 3*a*, and has the other end of it joined to the electron beam entrance end of the first inner conductor 4 via fan-shaped conductors 23. As seen in FIGS. 9, 10, a bunching gap 24 is formed by cutting slots 24*a* at plural symmetrical positions (two in FIG. 9 and four in FIG. 10) along the circumference of the cylindrical conductor 22. The accelerator operates in the same way as in the first embodiment.

[Embodiment III]

Figure 11:
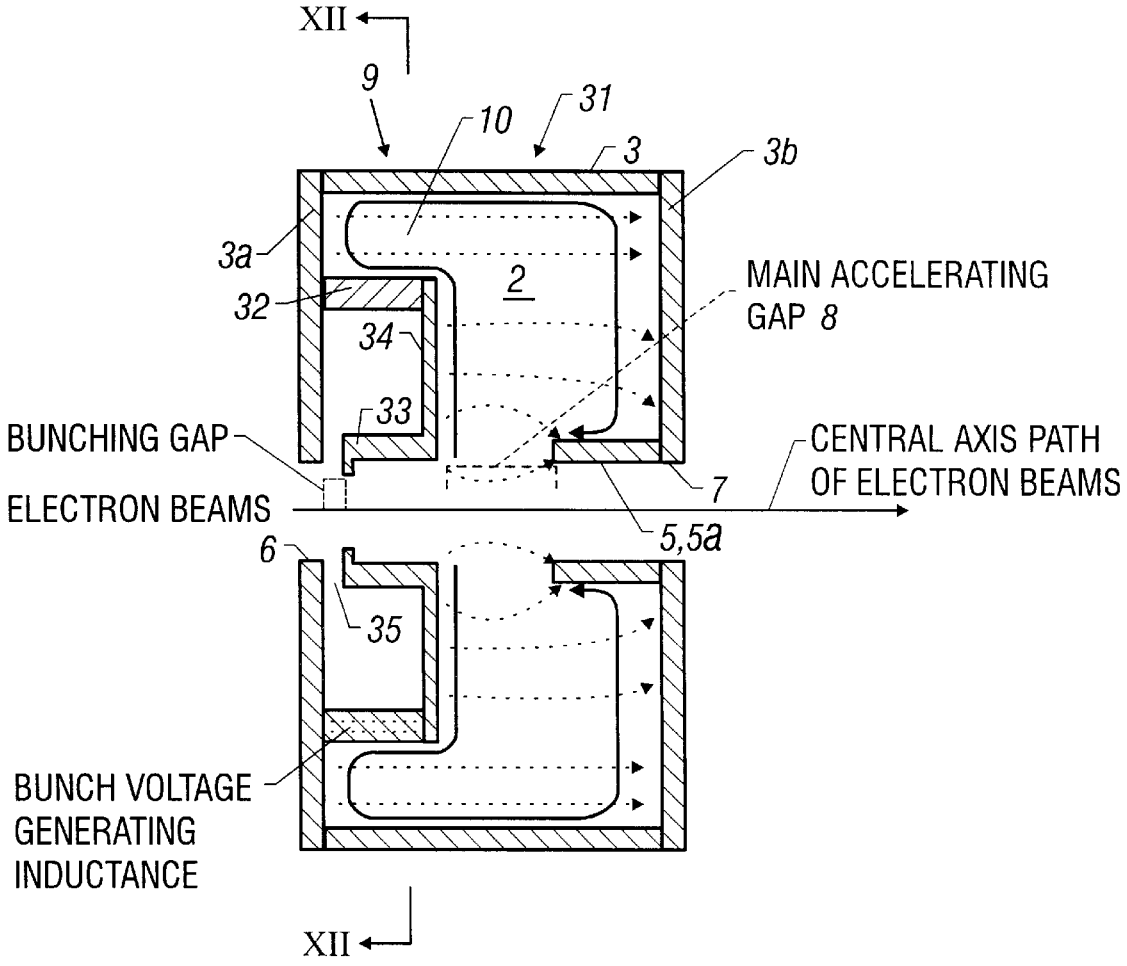
FIG. 11 is a cross-sectional diagram showing an arrangement of a buncher built-in type RF particle accelerator according to a third illustrative embodiment of the invention.
Figure 12:
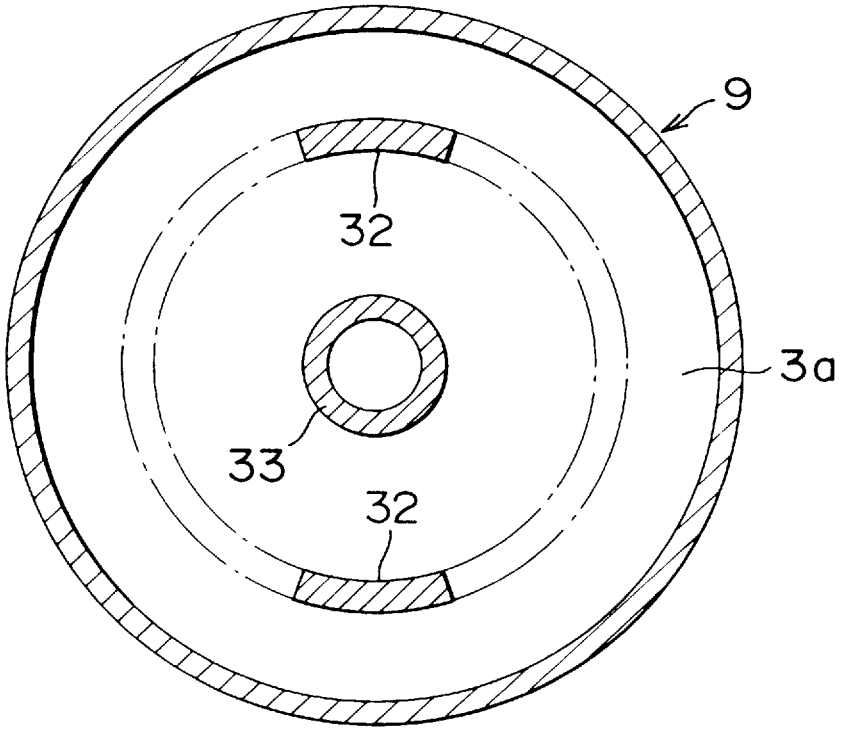
FIG. 12 cross-sectional diagram taken along the line XII—XII of FIG. 11.
Figure 13:
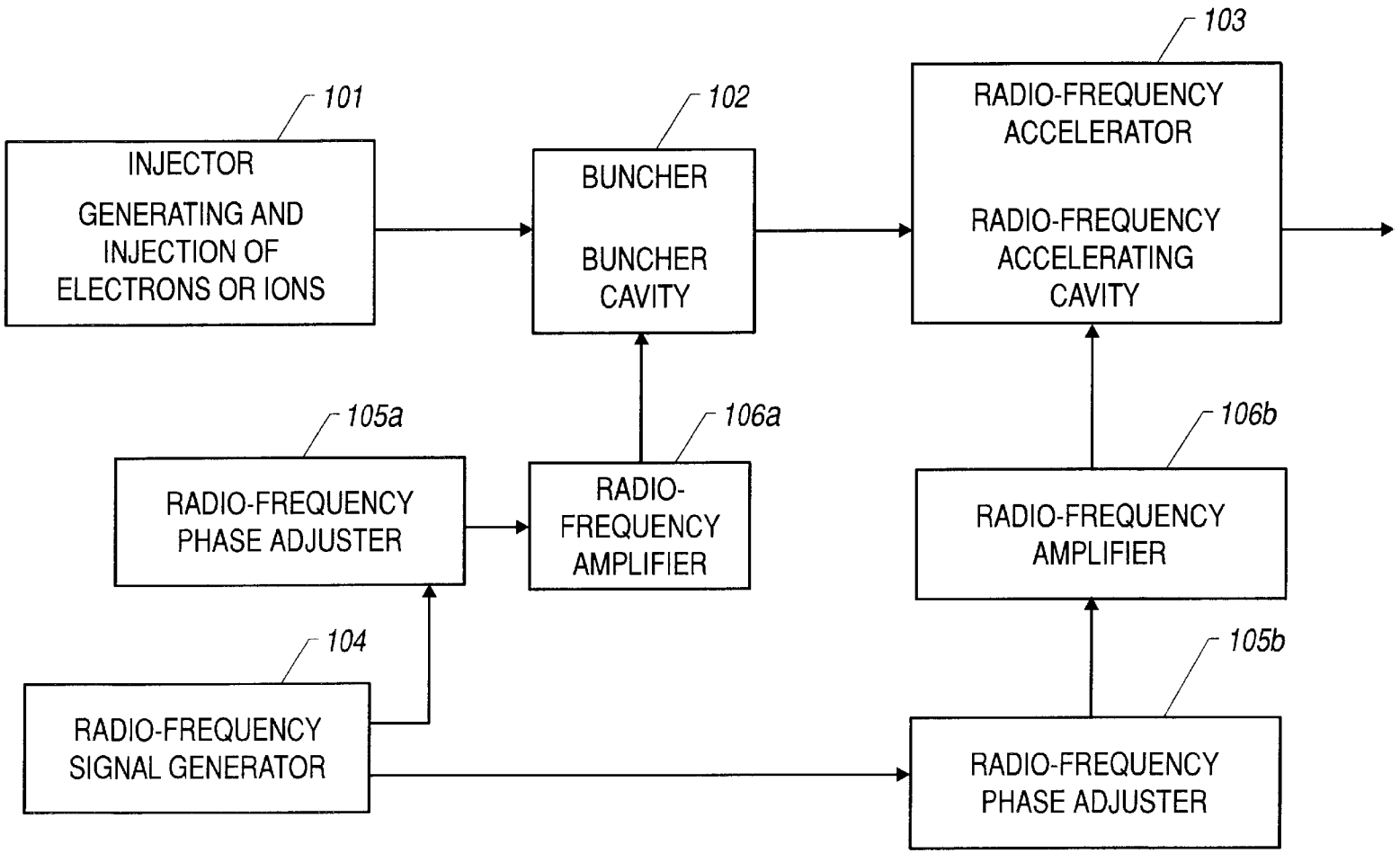
FIGURE 13 (PRIOR ART)
FIG. 13 is a block diagram showing an arrangement of an conventional RF particle accelerator.
Figure 14:
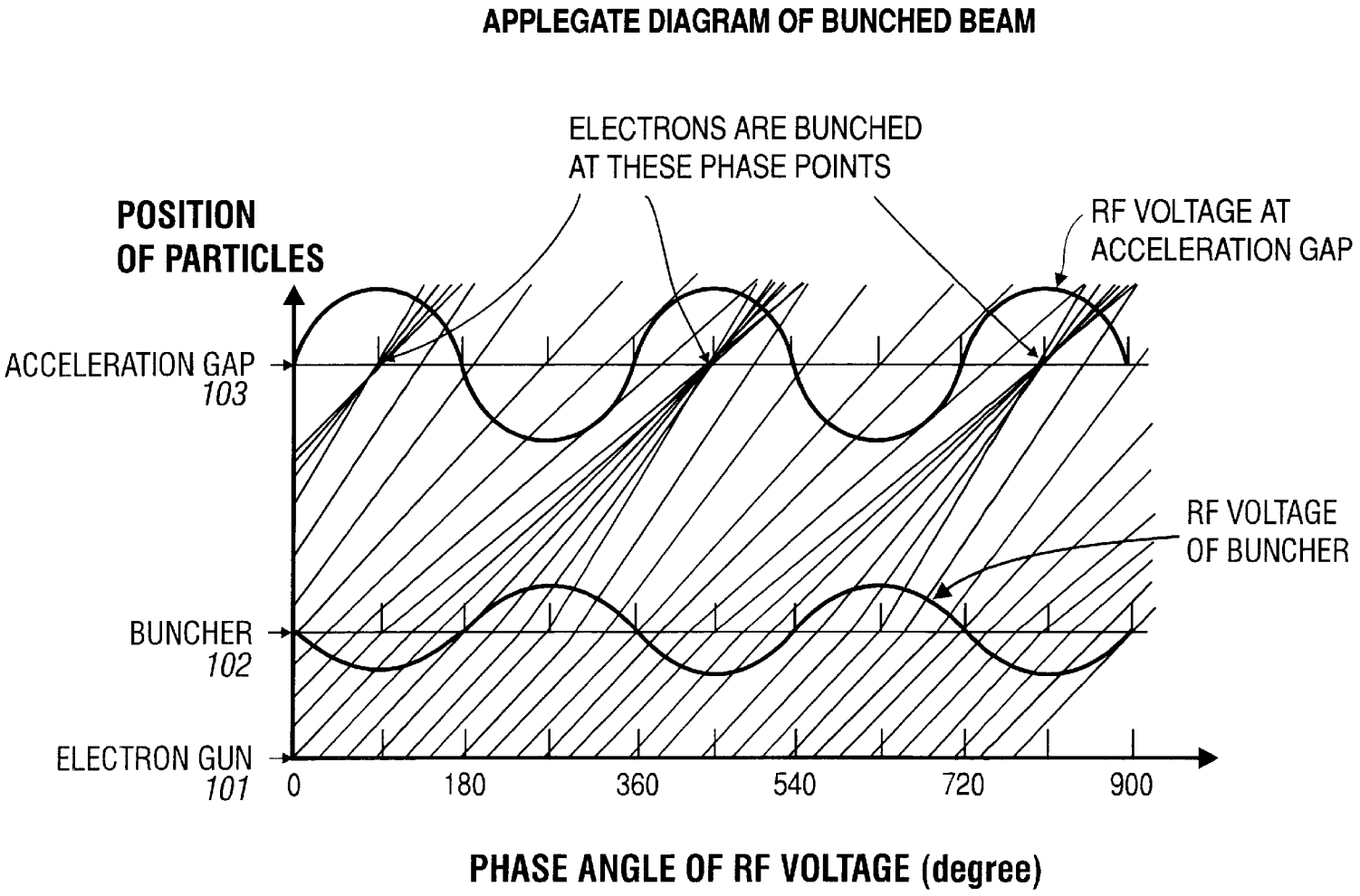
FIGURE 14 (PRIOR ART)
FIG. 14 an applegate diagram of the particles after passing through a buncher.

FIG. 11 is a longitudinal cross-sectional perspective diagram showing an arrangement of a built-in buncher type RF particle accelerator according to a third illustrative embodiment of the invention; FIG. 12 is a cross-sectional diagram taken along the line XII—XII of FIG. 11, where elements identical to those shown in FIG. 1 are labeled with identical numerals, and their explanations are omitted.

In FIG. 11, elements identical to those shown in FIG. 1 are labeled with identical numerals, and their explanations are omitted.

The RF particle accelerator 31 shown in FIG. 11 is an illustrative embodiment having a bunching voltage section in which the structure of the first stem corresponding to 4*a* (the first inner conductor 4) of FIG. 1 is different from those described above.

Instead of the first inner conductor 4, a first cylindrical inner conductor 32 which has slots and has an inner and an outer diameters larger than those of the second inner conductor 5 is disposed in the position where the first inner conductor 4 used to be. One end of the first inner conductor 32 is joined to an end plate 3*a* of the outer conductor 3. A third cylindrical inner conductor 33 is disposed on the axis of the electron beams in the first inner conductor 32, and the electron beam exit ends of the first and third cylindrical inner conductors 32 and 33 are connected to each other via a ring conductor 34. Thus, a bunching gap 35 is formed between the end plate 3*a* of the accelerating cavity outer conductor 3 and the entrance end of the third inner conductor 33.

In this way, an RF electric power for exciting the space 10 can induce voltage in the bunching gap 35 through inductance caused by the slots of the first inner conductor 32.

The electric field and the electric current of a TM010 mode in the RF particle accelerator 31 are shown in FIG. 11, wherein lines of electric force are indicated by broken lines, and the RF current flows by solid lines on the inner wall surface of the accelerating cavity 2.

It is noted that even if each embodiment shown in FIG. 1, 8 and 11 does not have the second inner conductor at the exit side of the accelerating cavity outer conductor, the embodiment will achieve the same function.

In FIG. 12, elements identical to those shown in FIG. 11 are labeled with identical numerals, and their explanations are omitted.

Though the present invention has been described in terms of some illustrative embodiments, it is apparent to those having ordinary skill in the art that other various arrangements may be constructed without departing from the spirit and scope of the present invention. It should be therefore understood that the present invention is not limited to the specific embodiments described in the specification, but should rather be construed broadly within its spirit and scope as defined in the appended claims.

As is apparent from the foregoing, according to the present invention, the structure of the RF particle accelerator becomes very simple without need of using any insulator for the buncher or using a buncher outside of the accelerating cavity, because the buncher becomes an integral part of the accelerating cavity, and RF electric power for exciting the buncher is supplied from the accelerating cavity through inductance. This permits an improvement in the reliability, availability and durability of the accelerator.

Furthermore, according to the invention, supplying an RF electric power to the accelerating cavity enables a part of the RF electric power automatically fed to the buncher, resulting in a very simple accelerator system easy to operate.

I claim:

1. A radio-frequency particle accelerator for accelerating a charged particle beam along an axis with a radio-frequency electric field comprising a radio-frequency particle accelerating cavity and a cylindrical first inner conductor which surrounds the axis of a particle beam, said first inner conductor having an outer circumferential surface, said first inner conductor having an inductance, said first inner conductor situated inside said radio-frequency particle accelerating cavity, said first inner conductor having a beam entrance and exit and said accelerating cavity having a beam entrance end and a beam exit end and said accelerator including an outer conductor joined to said beam entrance end and said beam exit end, an accelerating gap at the beam exit of said first inner conductor, said outer conductor arranged to provide a resonant cavity with a capacitance across said accelerating gap, and windows having closed peripheral edges, said windows are circumferentially disposed at a plurality of locations on said first inner conductor so as to generate bunch voltage generating inductances at said peripheral edges of said windows, a cylindrical third inner conductor surrounds the axis of said particle beam inside said first inner conductor, said first and third inner conductors having respective particle beam entrance and exit end sides, the respective particle beam exit end sides of the first and third inner conductors are joined to each other, said outer conductor having an end plate such that a bunching gap is provided between the end plate of said outer conductor and the particle beam entrance end side of said third inner conductor, such that radio-frequency power supplied to said accelerator is divided by said bunch voltage generating inductances and the inductance of said first inner conductor and the radio-frequency power generated in said bunch voltage generating inductance is supplied to said bunching gap so as to synchronize the particle beam to a radio-frequency accelerating phase.

2. The radio frequency particle accelerator according to claim 1 including a cylindrical second inner conductor which surrounds the axis of a particle beam, spaced from said first inner conductor so as to form said accelerating gap.

3. A radio-frequency particle accelerator for accelerating a charged particle beam along an axis with a radio-frequency electric field comprising a radio-frequency particle accelerating cavity and a cylindrical first inner conductor which surrounds the axis of the particle beam, said first inner conductor having an outer circumferential surface, said first inner conductor having an inductance, said first inner conductor situated inside said radio-frequency particle accelerating cavity, said first inner conductor having a beam entrance and exit and said accelerating cavity having a beam entrance end and a beam exit end and said accelerator including an outer conductor joined to said beam entrance end and said beam exit end, an accelerating gap at the beam exit of said first inner conductor, said outer conductor arranged to provide a resonant cavity with a capacitance across said accelerating gap, and a cylindrical conductor having a larger diameter than a diameter of said first inner conductor is disposed and is joined on the axis of said particle beam between said entrance end of said first inner conductor and said accelerating cavity outer conductor so that a bunching gap is provided inside said inner cylindrical conductor, windows having a closed peripheral edges, said windows are circumferentially disposed at a plurality of locations on said cylindrical conductor so that said windows generate inductances coupled in parallel with said bunching gap, such that radio-frequency power supplied to said accelerator is divided by the inductances generated by said windows and of said first inner conductor so that a part of said radio-frequency power is supplied to said bunching gap.

4. The radio frequency particle accelerator according to claim 3 including a cylindrical second inner conductor which surrounds the axis of a particle beam, spaced from said first inner conductor so as to form said accelerating gap.

5. A radio-frequency particle accelerator for accelerating a charged particle beam along an axis with a radio-frequency electric field comprising a radio-frequency particle accelerating cavity and a cylindrical first inner conductor which surrounds the axis of the particle beam, said first inner conductor having an outer circumferential surface, said first inner conductor having an inductance, said first inner conductor situated inside said radio-frequency particle accelerating cavity, said first inner conductor having a beam entrance and exit and said accelerating cavity having a beam entrance end and a beam exit end and said accelerator including an outer conductor joined to said beam entrance end and said beam exit end, an accelerating gap at the beam exit of said first inner conductor, said outer conductor arranged to provide a resonant cavity with a capacitance across said accelerating gap, and windows, each having a closed peripheral edge, are circumferentially disposed on the outer circumferential surface of said first inner conductor so as to provide a bunching gap inside said first inner conductor and so that said windows generate inductances coupled in parallel with said bunching gap, such that radio-frequency power supplied to said accelerator is divided by the inductances generated by said said windows and of said first inner conductor, so that a part of said radio-frequency power is supplied to said bunching gap so as to synchronize the particle beam to a radio-frequency accelerating phase.

6. The radio frequency particle accelerator according to claim 5 including a cylindrical second inner conductor which surrounds the axis of a particle beam, spaced from said first inner conductor so as to form said accelerating gap.

7. The radio-frequency particle accelerator according to claim 5, wherein said windows on said first inner conductor are symmetrically disposed at a plurality of locations in the outer circumferential surface of said inner conductor.

* * * * *